United States Patent [19]

Tammera

[11] Patent Number: 4,917,649

[45] Date of Patent: Apr. 17, 1990

[54] TOY VEHICLE WITH SIMULATED LOADING

[76] Inventor: Robert F. Tammera, 56 Gilbert Pl., W. Orange, N.J. 07052

[21] Appl. No.: 392,106

[22] Filed: Aug. 10, 1989

[51] Int. Cl.[4] ..... A63H 17/00; A63H 17/14; A63H 17/40

[52] U.S. Cl. ..... 446/427; 446/94; 446/441; 238/10 F

[58] Field of Search ..... 238/10 F, 10 A; 105/1.5; 446/427, 94, 95, 96, 93, 91, 90, 88, 85, 423, 424, 425, 426, 428, 429, 430, 443, 431, 432, 433, 434, 469, 470, 471, 475, 483, 441, 442

[56] References Cited

U.S. PATENT DOCUMENTS

| | | | |
|---|---|---|---|
| 2,240,124 | 4/1941 | Smith | 446/427 |
| 2,266,091 | 12/1941 | Smith | 446/275 |
| 2,290,844 | 7/1942 | Smith | 446/168 |
| 2,302,142 | 11/1942 | Pettit | 446/427 |
| 2,356,895 | 8/1944 | Smith | 446/427 X |
| 2,531,056 | 11/1950 | Koesten | 446/430 X |
| 2,607,163 | 8/1952 | Lohr | 446/434 |
| 3,214,864 | 11/1965 | Herman | 446/427 X |
| 3,986,294 | 10/1976 | Pfeilsticker et al. | 446/427 |
| 4,031,659 | 6/1977 | Keller et al. | 446/427 |
| 4,060,931 | 12/1977 | Knott | 446/428 X |
| 4,500,299 | 2/1985 | Kelley et al. | 446/88 X |
| 4,516,952 | 5/1985 | Brand et al. | 446/427 |
| 4,571,205 | 2/1986 | Zaruba et al. | 446/428 X |
| 4,710,149 | 12/1987 | Prusman | 446/433 X |
| 4,717,367 | 1/1988 | Stubenfoll et al. | 446/441 X |

FOREIGN PATENT DOCUMENTS

| | | | |
|---|---|---|---|
| 2541585 | 8/1984 | France | 446/427 |
| 1025439 | 6/1983 | U.S.S.R. | 446/433 |
| 1423426 | 2/1976 | United Kingdom | 446/470 |
| 2128889 | 5/1984 | United Kingdom | 446/470 |

*Primary Examiner*—Mickey Yu
*Assistant Examiner*—D. Neal Muir
*Attorney, Agent, or Firm*—Weingram & Zall

[57] ABSTRACT

A toy load carrying vehicle includes a body having a cavity and a load which is movable into and out of the cavity to simulate loading and unloading. The load includes a downwardly extending tab engageable with surface tabs at the ends of a path travelled by the vehicle. As the vehicle moves from one end to the other the engaging tabs cause the load to move into and out of the body. The vehicle may be a toy fork lift truck which moves along a toy train platform from a building at one end to a train car on tracks alongside the platform at the other end. The platform includes a slotted path and a drive mechanism below the platform connected to the truck through the slot to move the truck and load along the path. The load is moved out of the truck when it engages a tab within the building to simulate the loading and is moved into the truck when it engages a tab at the edge of the platform to simulate unloading at the train car. The truck is returned to the building with the load not being visible until the cycle is repeated. Different drive mechanisms can provide a single cycle or continuous operation.

11 Claims, 3 Drawing Sheets

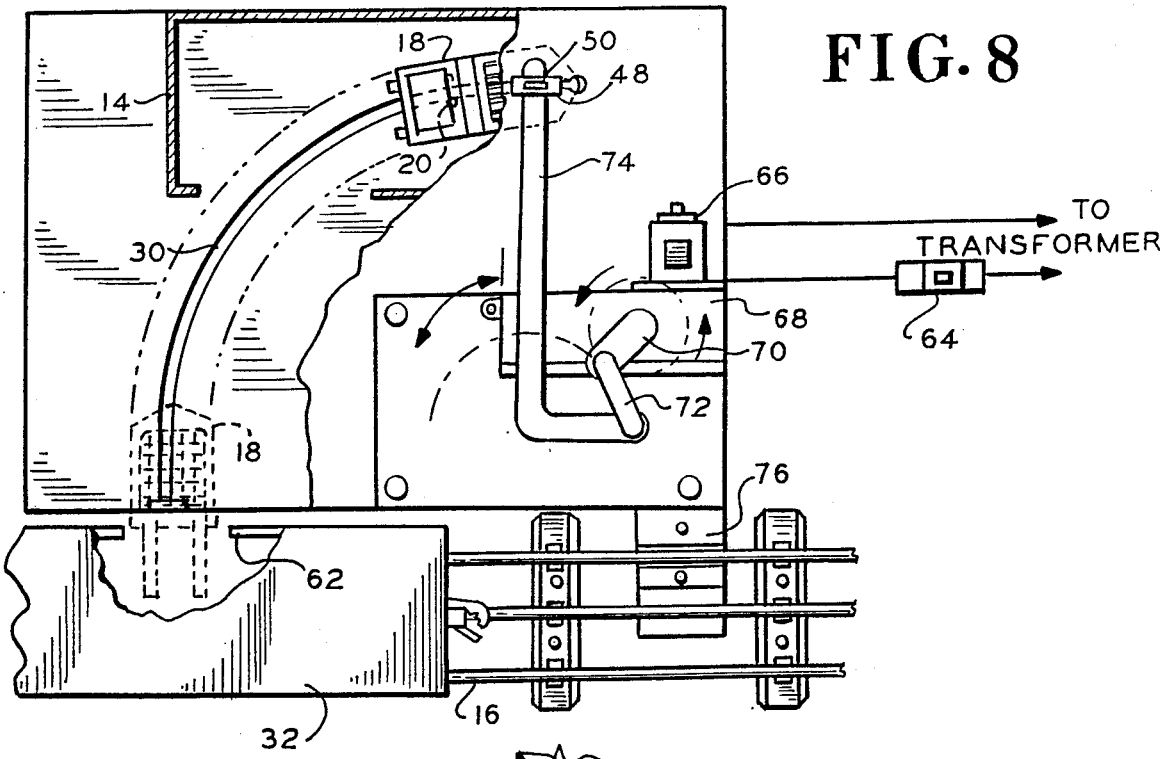
FIG. 8
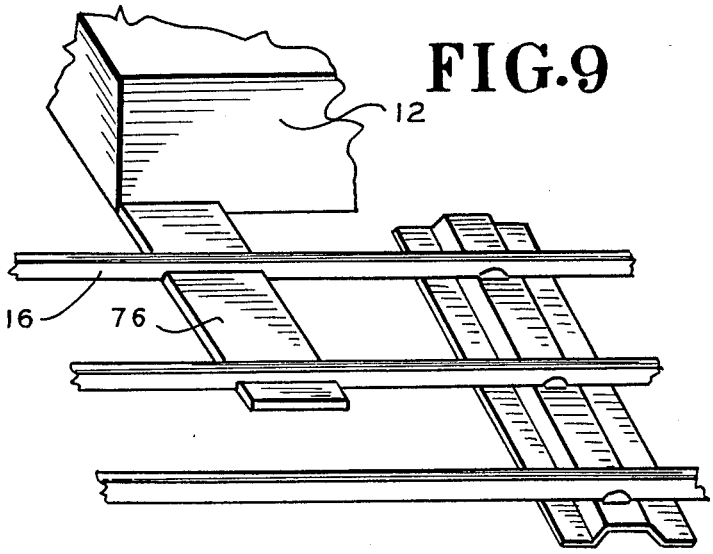
FIG. 9
FIG. 10
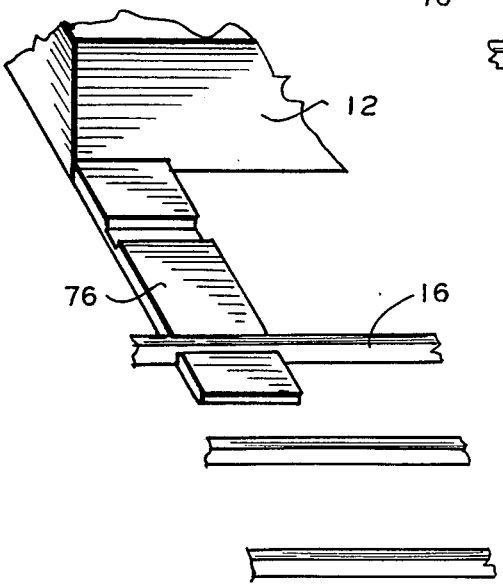

TOY VEHICLE WITH SIMULATED LOADING

BACKGROUND OF THE INVENTION

1. Field of the Invention

The present invention relates to a miniature toy load carrying vehicle and particularly to a mechanism which simulates the transfer of a load from a building to a fork lift truck and the unloading of the truck into a toy train car or other vehicle.

2. Description of the Prior Art

Previous devices for transferring articles between toy train cars and loading platforms have employed electromagnetic ejecting mechanisms such as solenoids which catapult or throw the articles from a car onto a platform, such as shown in U.S. Pat. No. 2,302,142. A similar mechanism is shown in U.S. Pat. No. 2,266,091 wherein simulated baggage is thrown from a station platform onto a toy baggage truck and from the truck into a freight car and unloaded in a reverse sequence. Another mechanism utilizes a tilted track and vertical stakes which hold a load of simulated logs on a toy train car. An obstruction along the track engages an element on the car to cause a pair of stakes to pivot and release the load which rolls onto a platform, as shown in U.S. Pat. No. 2,290,844.

Another device for simulating the transfer of baggage from a platform to a baggage truck and from the truck to a train car is shown in U.S. Pat. No. 2,240,124. In this mechanism, an illusion is created by a simulated piece of baggage which is on a platform adjacent a toy railway station and which disappears into the body of the platform while simultaneously another simulated baggage piece appears on an adjacent baggage truck. The baggage truck moves to a toy railroad car where the baggage disappears into the truck body to simulate unloading into the train car. The sequence is reversible to simulate unloading from the train to the truck and then to the platform. This is accomplished by mechanically raising or lowering a block on the platform and on the truck alternately in synchronism utilizing electrically operated solenoids and switches. The use of toy fork lift vehicles having operating lifting mechanisms is also known, as shown in U.S. Pat. No. 3,986,294.

These devices however are relatively complex and require many mechanical elements and electrical circuits and controls.

SUMMARY OF THE INVENTION

It is therefore the primary object of the present invention to provide a simplified mechanism for simulating the transfer of a load between a toy housing and a vehicle and between the vehicle and a toy train car or another vehicle.

It is another object of the invention to simulate the loading and unloading of a toy fork lift truck.

A further object of the invention is to provide a simple mechanical device for moving a load horizontally into and out of the body of a vehicle to simulate loading and unloading.

An additional object of the invention is to synchronize the movement of the vehicle and load to appear that the vehicle is loaded when moving in one direction between a station building and a train car and unloaded when moving in the other direction.

It is also an object of the invention to provide a drive mechanism for moving the vehicle along a path and for controlling the movement to occur in a single cycle or to be continuous.

These objects are achieved with a unique mechanism wherein a toy fork lift truck or similar vehicle includes a rectangularly shaped load which is slidable horizontally into and out of a hollow rectangular cavity within the truck body. A drive mechanism positioned below a station platform is connected to the truck through an elongated slot in the platform to move the truck along a path defined by the slot. A pair of vertically extending tabs at the opposite ends of the slotted path move the load horizontally into and out of the truck body as the truck passes over the tabs. Thus, in one embodiment, the truck moves from a starting position within a doorway of a station house with a load extending outwardly on the fork of the truck and moves along the slotted path to the end of the platform adjacent a train car on tracks. The vertical tab at the track end engages the load and causes the load to be moved within the truck body to simulate unloading as it moves into the door of the train car. On the return path, the load remains within the body of the truck until reaching the vertical tab at the other end within the station house door, whereupon the load is pushed out of the truck to simulate the loading action. The directions of movement and sequence of loading and unloading may also be reversed. A solenoid driving a rack, pinion and lever arrangement can provide the forward motion with a spring return mechanism to operate one cycle each time a switch is actuated. A motor drive and gear mechanism with a linkage and rotating arm can also provide a continuous back and forth movement.

Other objects and advantages will become apparent from the following description in conjunction with the accompanying drawings.

BRIEF DESCRIPTION OF THE DRAWINGS

The invention is illustrated in the accompanying drawings in which:

FIG. 8 is a top view of a continuous motor drive mechanism positioned under the platform which is partially cut away and shows the fork lift truck movement into the train on tracks adjacent the platform.

FIG. 9 is a perspective view of one arrangement of tracks alongside the platform to permit the fork lift truck to enter the train car.

FIG. 10 is another track arrangement wherein the tracks are spaced further from the platform to cause the fork lift truck to stop movement at the entrance to the train car.

DESCRIPTION OF THE PREFERRED EMBODIMENT

Figure 1:
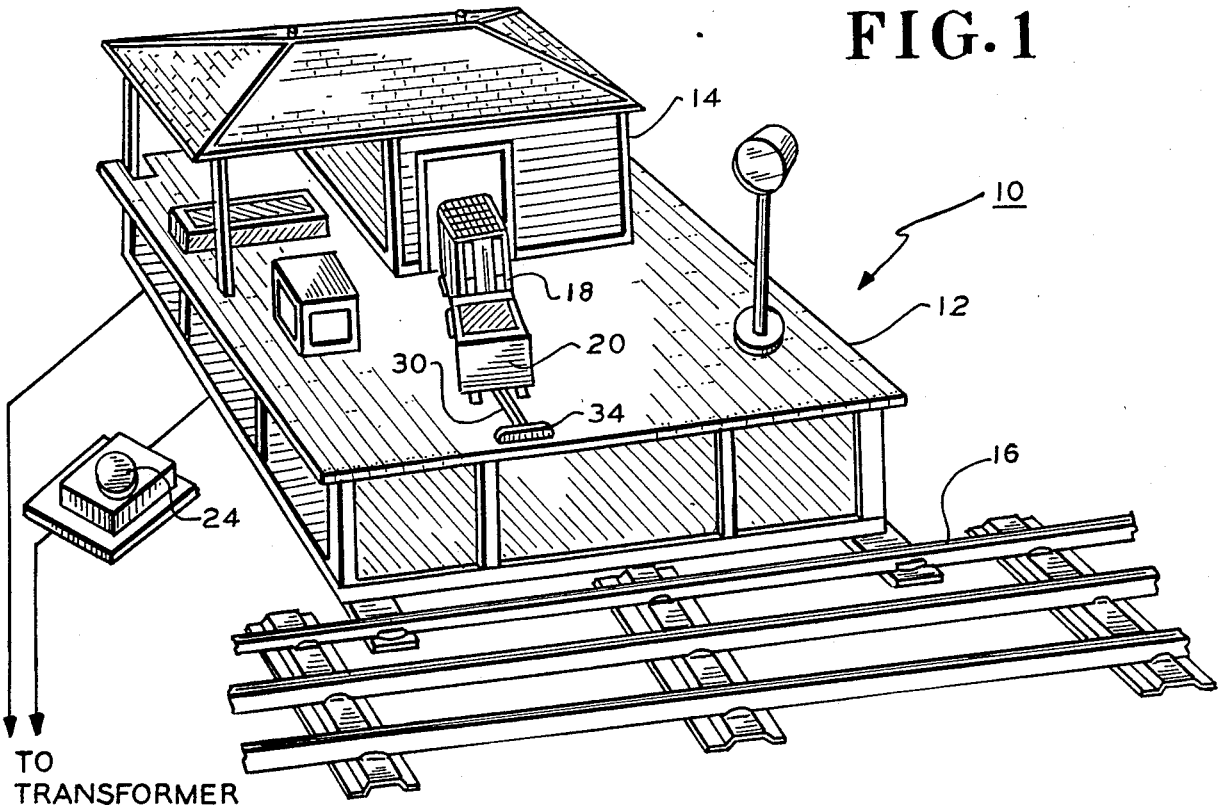
FIG. 1 is a top perspective view showing a toy train station including a building, a toy fork lift truck guided along a slotted path in a platform, and train tracks running along the front of the platform.
Figure 2:
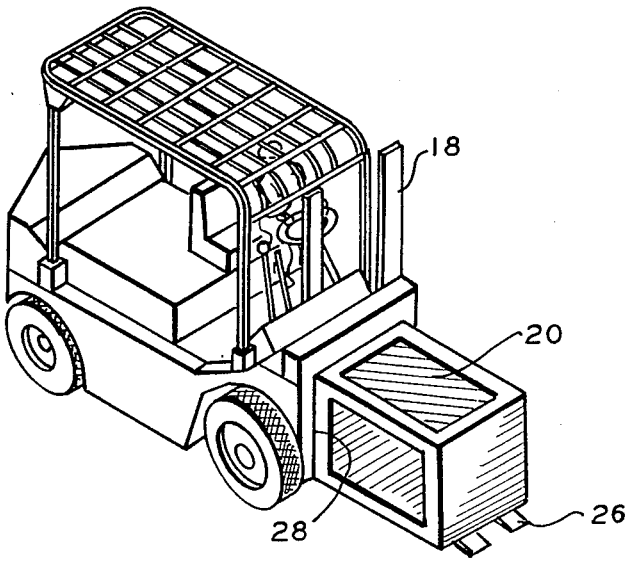
FIG. 2 is a side perspective view of a toy fork lift truck with an extending load.
Figure 3:
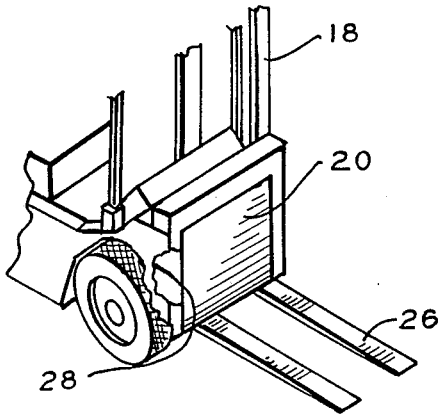
FIG. 3 is a view of the fork lift truck with the load retracted and concealed within the truck body.
Figure 5:
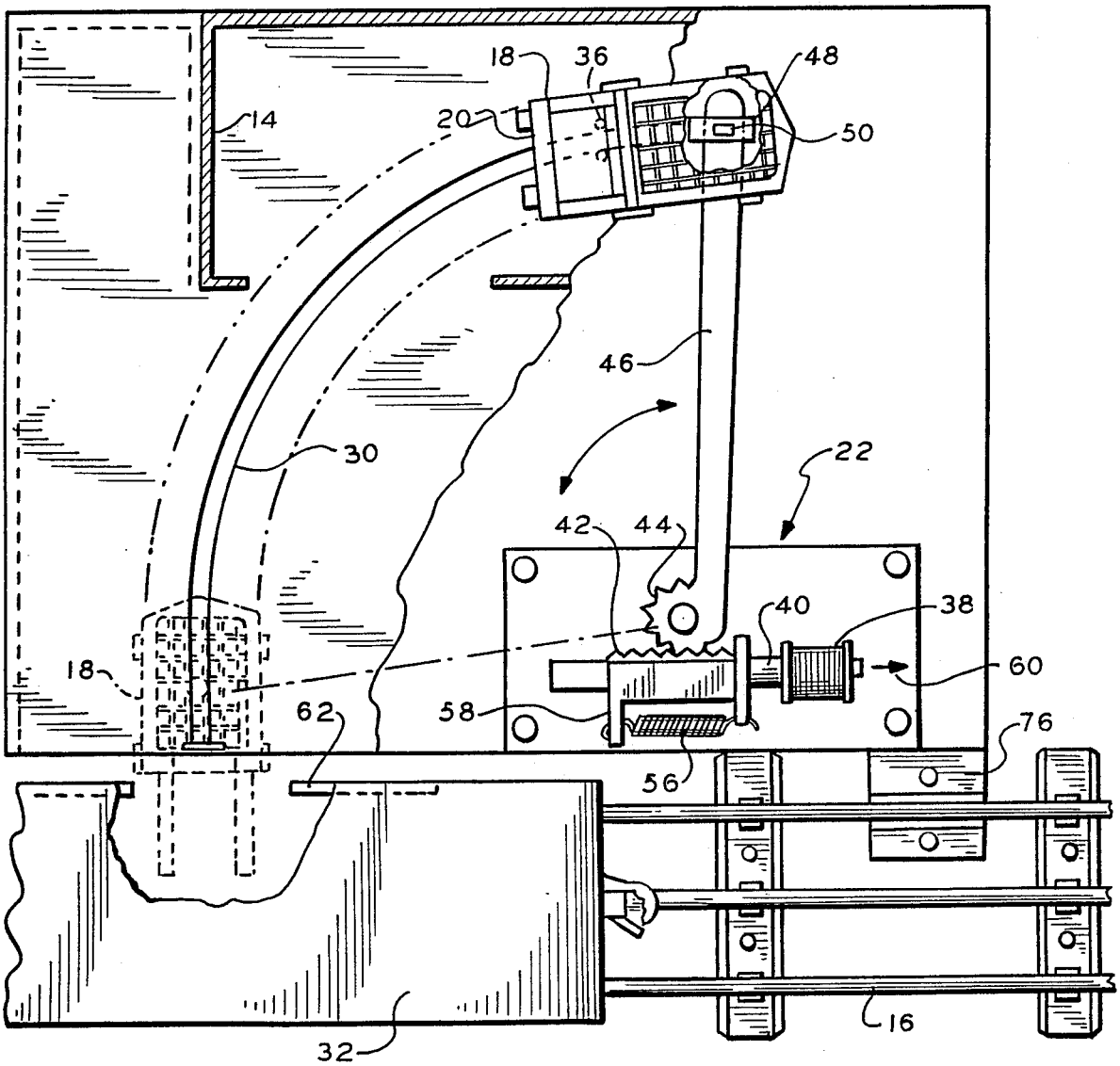
FIG. 5 is a top view in partial cross-section of a first single cycle solenoid drive mechanism positioned under the platform which is partially cut away and shows the fork lift truck movement from the building to the train car.

As shown in FIG. 1, a toy train station 10 includes a platform 12 with a depot building 14, tracks 16 along the front of the platform, and a miniature fork lift truck 18 carrying a simulated load 20. A drive mechanism 22, shown in more detail in FIG. 5, is positioned under the platform and is actuated by a push button switch 24 connected to an electrical power outlet though a transformer, not shown. The fork lift truck is shown in further detail in FIGS. 2 and 3. The rectangular shaped load 20 is supported on a pair of fork lifts 26 and is slidable into and out of a hollow cavity 28 in the body of the vehicle.

Figure 4:
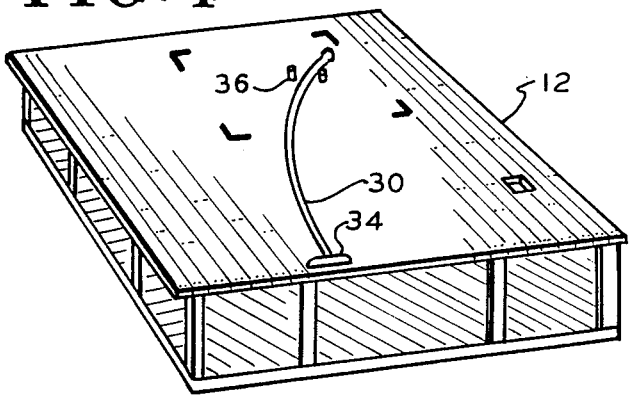
FIG. 4 is a top perspective view of the platform showing the slotted path and vertical tabs at the ends of the path.

As shown in FIG. 4, the platform includes an elongated narrow slot 30 through which the drive mechanism is connected to the truck and which provides a path to move the truck between the building and a toy train box car 32 on the tracks, as further illustrated in FIG. 5. A pair of vertical tabs 34, 36 are positioned at opposite ends of the slot, with tab 34 extending upwardly at the edge of the platform adjacent the tracks, and tab 36, with the slot therethrough extending from the platform within building 14.

Figure 6:
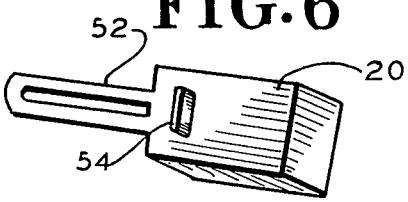
FIG. 6 is a bottom view of the load showing a vertical tab which is engageable with the platform tabs for moving the load.
Figure 7:
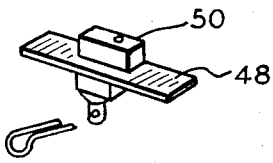
FIG. 7 illustrates a load guide plate and slide member for engaging and moving the fork lift truck.

As shown in FIG. 5, the drive mechanism below the platform includes an electrically energized solenoid 38 surrounding a movable plunger 40 connected to a toothed rack 42. The rack engages a pinion gear 44 forming an end of a lever 46. Secured to the other end of the lever is a load guide plate 48, as shown in more detail in FIG. 7, having a vertical slide member 50. Slide 50 extends through the platforms lot 30 into the truck and though a slotted bracket 52 connected to load 20 which is slidable along forks 26. The load and bracket are shown in a bottom view in FIG. 6. Slide member 50 is connected to the truck which moves together with lever 46. Bracket 52 includes a downwardly extending vertical tab 54 at the connection to the load. A return spring 56 is connected between a mounting bracket 58 and a flange of the rack 42, as shown in FIG. 5.

In operation, when the push button 24 is actuated and held down, solenoid 38 is energized to pull plunger 40 to the right, as indicated by the arrow 60. At this time, the fork lift truck 18 is in a starting position in building 14 with the load 20 extending outwardly. Plunger 40 causes pinion gear 44 and lever 46 to rotate counterclockwise. Guide plate 48 and slide member 50 also move with lever 46 and cause the truck and load to move along path 30. When the load tab 54 engages platform tab 34, the load is pushed back into cavity 28 as the truck moves forward to the end of the path adjacent the tracks and box car 32 and into an open doorway 62. The load thus disappears into the truck body and gives the appearance of having been unloaded into the box car.

When button 24 is released, spring 56, which has been extended during the movement of plunger 40 and rack 42 to the right with the counterclockwise movement of lever 46, is now also released to contract and cause the truck 18 and lever 46 to move back along path 30 in a clockwise direction. As the truck passes through the open doorway of building 14, tab 54 on the load engages raised tab 36 on the platform to cause the load to be pushed out of the cavity of the truck and again appear on forks 26. The single operating cycle is completed at this point and ready for the next cycle upon another actuation of the push button switch 24. When the truck again exits from the building with the extending load, it appears as if the truck has picked up another load to carry to the train. The action thus simulates the loading and unloading of the fork lift truck as it moves between the building and box car. A tooth disposed on an inner end of the load and a ratchet above the load within the cavity of the fork lift truck may be used to hold the load in position during movement of the truck.

Another type of drive mechanism is shown in FIG. 8, wherein a continuous back and forth movement may be provided. Switch 64 is preferably a low voltage switch which, for example, may be a 12 volt switch that can operate on either D.C. or A.C. It also is preferably a type which can be pressed for selecting a given cycle of operation or can be locked in place for continuous operation. Switch 64 actuates a miniature electric motor 66 driving a gear box 68 which connects to a rotating arm 70. Arm 70 is connected to one end of a link arm 72 which is in turn connected to one end of an L-shaped swing arm and bell crank 74.

The other end of arm 74 is under the end of path 30 within building 14. As arm 70 rotates counterclockwise it pulls link arm 72 around in a circle of a radius equal to the length of arm 72. At one-half revolution, arm 70 rotates 180 degrees with arm 72 aligned with arm 70 across the circular path and the small section of swing arm 74 so that the larger section of arm 74 is at an angle of 45 degrees. After a single complete revolution of arm 70, the L-shaped swing arm 74 has rotated 90 degrees and completes the travel of the end of arm 74 along arcuate path 30. Fork lift truck 18 is connected to the end of arm 74 via load guide plate 48 and slide member 50 extending through slotted path 30 and operates with the load 20 in conjunction with platform tabs 34,36 in the same manner as described in connection with the drive mechanism of FIG. 5. One additional continued full rotation of arm 70 than returns arm 74 and link arm 72 to the original starting position. Thus, truck 18 retraces the path 30 from train car 32, where the load 20 appeared to be unloaded, back to the depot building where load 20 again moves into a forward loaded position ready for the next complete cycle of operation. This can be made continuous by switch 64 being moved into the locking position.

FIGS. 9 and 10 show a track bracket 76 connected to the front of platform 12 to provide a desired spacing of a standard three rail track 16 from the platform. In the closest position shown in FIG. 9, the fork lift truck 18 can enter the box car 32 so that the load retracts and appears to be unloaded within the box car for a more realistic operation. If desired however, the tracks can be positioned further from the platform, as shown in FIG. 10, with one rail held in bracket 76 instead of two. In this case, the load retracts into the fork lift truck as it reaches the end of the platform adjacent the box car door.

In another variation of the invention, the fork lift truck can be used for carrying a load between a warehouse building and another vehicle such as a toy motor truck instead of a depot building on a train platform and a box car on tracks. The fork lift truck can also be moved manually between the two points to simulate removal of a load from the warehouse and unloading into the back door of the motor truck. A tab can be positioned on the floor within the warehouse to engage a tab on the bottom of the load within the fork lift. As the fork lift enters the warehouse in a forward position, the fork lift can move up a ramp so that the load tab passes over the building tab which then pulls the load out of the body when the fork lift exits the building. The fork lift may then be turned and moved manually in a forward direction to reach a ramp leading up the back of the motor truck. Another tab on the floor of the motor truck can engage the load and push it back into the fork lift. The same type of operation with simulated loading and unloading of the fork lift can thus be utilized in other applications. The vehicle may take other forms instead of a fork lift and the load may have forms other than a box. For example, the load can be a simulated bundle of logs, pipes, cylindrical containers, or crates.

While a limited number of embodiments have been illustrated and described, other variations maybe made in the particular configurations without departing from the scope of the invention as set forth in the appended claims.

What is claimed is:

1. A toy load carrying vehicle comprising:

a body having a cavity therein for receiving a load; means secured to said body for enabling movement of said body along a surface;

support means on one end of said body for holding a load;

a load slidable on said support means and being movable into and out of said body cavity; and means extending downwardly from said load and engageable with means extending from said surface, movement of said body and load in one direction causing said downwardly extending means to engage said surface extending means and move said load into said cavity and movement in an opposite direction causing said load to be moved out of said cavity.

2. The vehicle of claim 1 wherein said support means is a fork lift, said vehicle being a fork lift truck, said load and cavity having rectangular shapes, said load being slidable horizontally and including a vertical tab engageable with a surface tab.

3. A toy vehicle simulated loading apparatus comprising:

a toy vehicle having a body with a cavity therein for receiving a load;

means secured to said body for enabling movement of said vehicle along a surface between two spaced end areas;

support means on one end of said body for holding a load;

a load slidable on said support means and being movable into and out of said body cavity;

a loading area at one said end of said surface and an unloading area at the other said end of said surface; upwardly extending tabs on said surface at said end areas; and a downwardly extending tab on said slidable load engageable with said upwardly extending tabs, movement of said vehicle and load to one end area causing engagement of said load tab with one surface tab to move said load into said cavity and movement of said vehicle and load tab to the other end area causing engagement of said load tab with the other surface tab to move said load out of said cavity.

4. The apparatus of claim 3 wherein said support means is a fork lift, said vehicle being a fork lift truck, said load and cavity having rectangular shapes.

5. The apparatus of claim 4 wherein said surface is a platform of a toy train station, one of said end areas including a housing on said platform, the other end area being at an edge of said platform, a set of toy train tracks positioned along said platform edge for supporting a toy train car thereon, a slotted path in said platform between said housing and edge, said surface tabs being at the respective ends of said slotted path, one of said tabs being within said housing, electromechanical drive means positioned below said platform, said drive means including an elongated arm having one end movable along said path between said housing and edge, an guide means connected between said one arm end and said fork lift truck through said slotted path, said drive means and guide means causing movement of said truck and load between said end areas and moving said load into said cavity upon engagement of said tabs at one end area and moving said load out of said cavity upon engagement of said tabs at the other end area.

6. The apparatus of claim 5 wherein said load is moved out of said cavity upon engagement of said tabs within said housing and moved into said cavity upon engagement of said tabs at said platform edge as the fork lift truck moves to enter said train car on said tracks at said edge, the load movement causing the load to appear to be carried from said housing and unloaded at said train.

7. The apparatus of claim 6 wherein said load includes a slotted bracket, said guide means being connected to said truck through said slotted path and slotted bracket to move said truck and load.

8. The apparatus of claim 7 wherein said drive means includes a solenoid, a plunger within said solenoid, a rack connected to said plunger, a pinion at the other end of said elongated arm engageable with said rack, electrical control means for actuating said solenoid to move said plunger and rack and pinion and arm to drive said truck and load along said path in one direction, and resilient means for driving said truck and load in the opposite direction.

9. The apparatus of claim 7 wherein said drive means includes a miniature motor and gearing, a first rotatable arm connected to said gearing, and a second rotatable arm connected between said first rotatable arm and the other end of said elongated arm, electrical control means for actuating said motor to rotate said first and second and elongated arms, one rotation of said first arm causing said elongated arm and truck and load to move from one end of said path to the other end, and a second rotation causing said elongated arm and truck and load to return to said one end of said path.

10. The apparatus of claim 9 wherein said electrical control means includes means for selectively providing a given cycle of operation of said drive means and for providing a continuous operation of said drive means.

11. The apparatus of claim 7 including means for spacing said tracks from said platform at two different positions, a first closer position permitting said truck and load to move into said train car on said tracks along said platform, and a second further position causing said truck and load movement to stop at the edge of said platform.

* * * * *